US008550045B2

(12) United States Patent
Noguchi et al.

(10) Patent No.: US 8,550,045 B2
(45) Date of Patent: Oct. 8, 2013

(54) VALVE TIMING CONTROL APPARATUS

(75) Inventors: Yuji Noguchi, Obu (JP); Takeo Asahi, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 394 days.

(21) Appl. No.: 12/881,680

(22) Filed: Sep. 14, 2010

(65) Prior Publication Data

US 2011/0061620 A1 Mar. 17, 2011

(30) Foreign Application Priority Data

Sep. 16, 2009 (JP) ..... 2009-214389

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | |
|---|---|---|---|
| 4,858,572 | A | 8/1989 | Shirai et al. |
| 5,875,750 | A | 3/1999 | Iwasaki et al. |
| 5,943,989 | A | 8/1999 | Kira |
| 6,079,382 | A | 6/2000 | Schafer et al. |
| 6,418,897 | B1 | 7/2002 | Urban et al. |
| 7,363,898 | B2 | 4/2008 | Suzuki et al. |
| 2009/0017920 | A1 * | 1/2009 | Fox et al. |

FOREIGN PATENT DOCUMENTS

| | | | |
|---|---|---|---|
| DE | 198 25 288 | A1 | 12/1998 |
| DE | 197 55 495 | A1 | 6/1999 |
| DE | 199 08 934 | A1 | 9/2000 |
| DE | 10 2007 056 549 | A1 | 5/2009 |
| EP | 0 807 746 | A1 | 11/1997 |
| JP | 01-092504 | A | 4/1989 |
| JP | 07-224617 | A | 8/1995 |
| JP | 3191865 | B2 | 7/2001 |
| WO | WO 2009/065732 | A1 | 5/2009 |

OTHER PUBLICATIONS

Extended European Search Report dated Feb. 21, 2012, issued by the European Patent Office in the corresponding European Application No. 10008352.6. (6 pages).

Official Action issued by Japanese Patent Office on Jul. 2, 2013 in Japanese Application No. 2009-214389, and English language translation of Official Action (5 pgs).

* cited by examiner

*Primary Examiner* — Ching Chang
(74) *Attorney, Agent, or Firm* — Buchanan Ingersoll & Rooney PC

(57) ABSTRACT

A valve timing control apparatus includes: a driving force transmission member; a driving side rotational member, to which a driving force is transmitted; a driven side rotational member coaxially provided to the driving side rotational member, and rotating relative to the driving side rotational member, thereby rotating a camshaft for opening and closing a valve; and a hydraulic pressure chamber formed by the driving side rotational member and the driven side rotational member. The driving side rotational member includes a housing formed into a closed-end cylindrical shape and having a bottom portion formed to close one end of the housing in an axial direction thereof and an opening portion formed to be opened at the other end the housing in the axial direction thereof, and a plate member closing the opening portion. The driving force transmission member, formed into a ring shape, is attached to the bottom portion.

12 Claims, 6 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2009-214389, filed on Sep. 16, 2009, the entire content of which is incorporated herein by reference.

TECHNICAL FIELD

This disclosure relates to a valve timing control apparatus for controlling a timing for opening and closing an intake valve and an exhaust valve of an internal combustion engine.

BACKGROUND DISCUSSION

A known valve timing control apparatus, disclosed in JP3191865B, includes a housing member and vane members. The vane members are respectively accommodated within hydraulic pressure chambers, formed at radially inner side of a circumferential wall of the housing member, so as to be rotatable relative to the housing member within a predetermined angle range. The housing member is configured by a front-side wall, the circumferential wall and a rear-side wall. The circumferential wall includes shoes for forming the hydraulic pressure chambers. The front-side wall and the circumferential wall are integrally formed by aluminum die-casting. The rear-side wall is formed separately from the front-side wall and the circumferential wall. The rear-side wall includes a timing gear.

According to the valve timing control apparatus, disclosed in JP3191865B, the circumferential wall and the front-side wall of the housing are integrally formed. Therefore, seal members for sealing connecting points of the circumferential wall and the front side wall may not be necessary. In a case where the seal members are not provided, an outer diameter of the housing member may be shortened. Further, the circumferential wall and the front-side wall of the housing are integrally formed. Therefore, a coaxial alignment of the circumferential wall and the front-side wall may not be necessary.

The rear-side wall of JP3191865B includes a timing gear for transmitting a driving force. Therefore, the rear-side wall is generally made of high-quality metal material, having abrasion resistance and sufficient strength. Further, the rear-side wall needs to be formed in a manner where a dimension thereof is sufficiently large so that a rear opening portion of the circumferential wall is closed by the rear-side wall in order to form the hydraulic pressure chambers. Therefore, because of the existence of the rear-side wall, the valve timing control as a whole may become expensive and a weight thereof may be increased.

A need thus exists for a valve timing control apparatus which is not susceptible to the drawback mentioned above.

SUMMARY

According to an aspect of this disclosure, a valve timing control apparatus includes: a driving force transmission member; a driving side rotational member, to which a driving force of an internal combustion engine is transmitted from a crank shaft of the internal combustion engine by the driving force transmission member; a driven side rotational member coaxially provided to the driving side rotational member, and rotating relative to the driving side rotational member, thereby rotating a camshaft for opening and closing a valve; and a hydraulic pressure chamber formed by the driving side rotational member and the driven side rotational member, and changing a rotational phase of the driven side rotational member relative to the driving side rotational member to an advanced angle direction or a retarded angle direction according to a supply of a hydraulic oil to the hydraulic pressure chamber. The driving side rotational member includes a housing formed into a closed-end cylindrical shape and having a bottom portion formed to close one end of the housing in an axial direction thereof and an opening portion formed to be opened at the other end the housing in the axial direction thereof, and a plate member closing the opening portion of the housing. The driving force transmission member, formed into a ring shape, is attached to the bottom portion of the housing.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

[First Embodiment]

Figure 1:
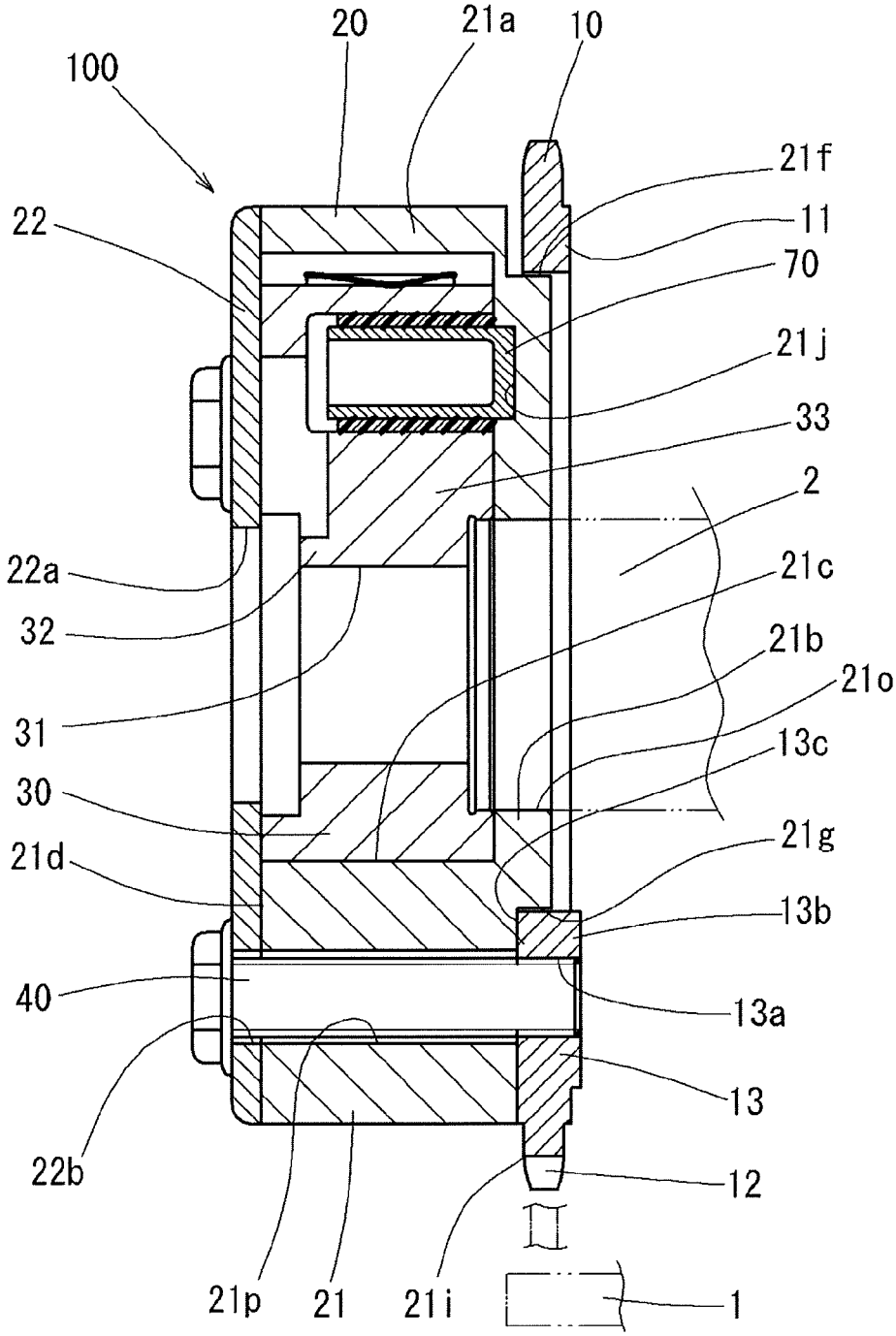
FIG. 1 is a cross-sectional view illustrating a valve timing control apparatus according to a first embodiment.
Figure 2:
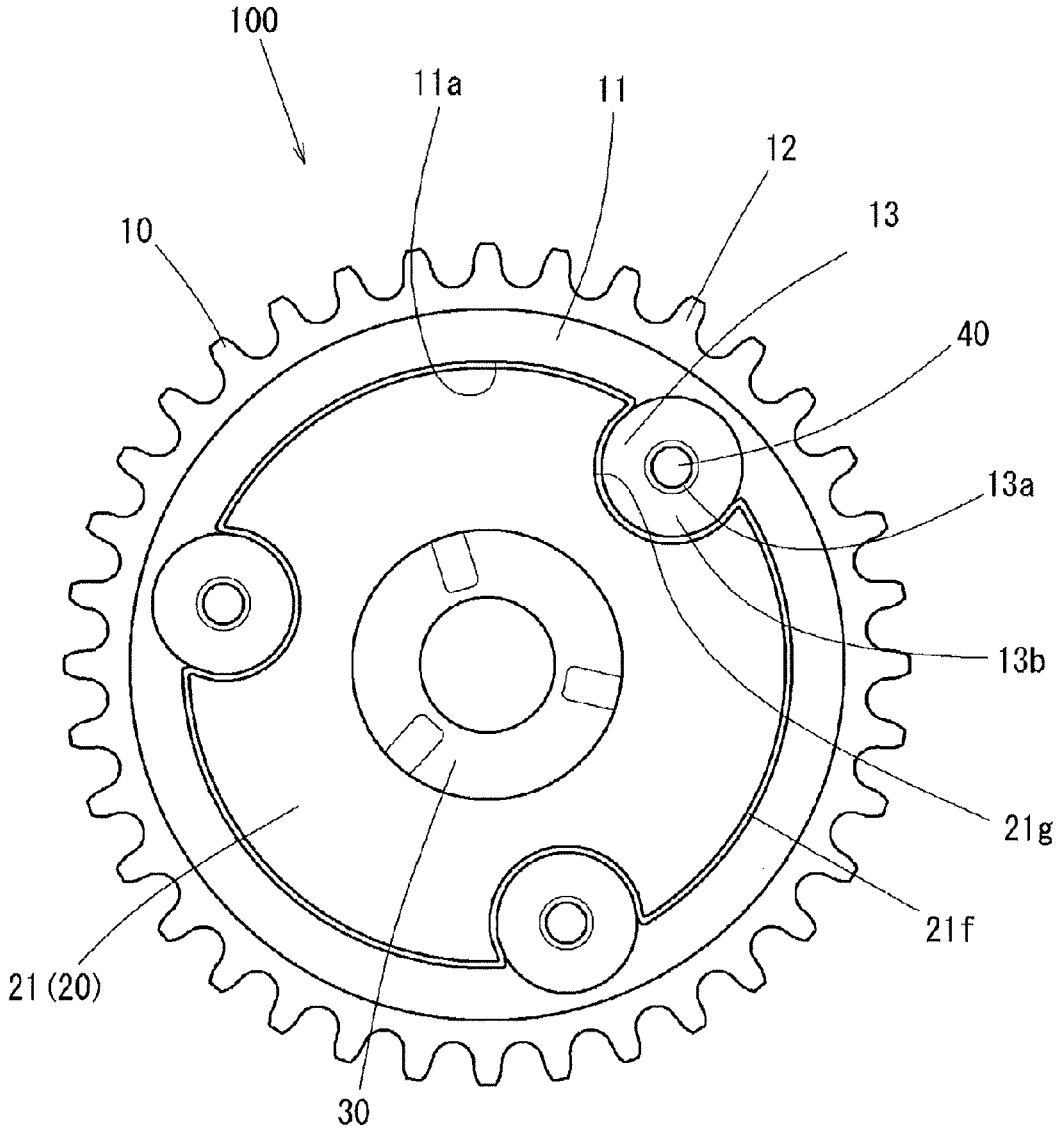
FIG. 2 is a back view illustrating the valve timing control apparatus according to the first embodiment.

A first embodiment of a valve timing control apparatus 100 will be described hereinafter with reference to FIGS. 1 to 5.

The valve timing control apparatus 100 includes a timing sprocket (a driving force transmission member) 10, to which a driving force of an engine (an internal combustion engine) is transmitted by means of a crank shaft 1 of the engine, a driving side rotational member 20, at which the timing sprocket 10 is fixed, and a rotor (a driven side rotational member) 30, which is rotatably engaged with the driving side rotational member 20. The rotor 30 is fixed to a camshaft 2 by means of bolts so as to open or close an intake valve or an exhaust valve of the engine.

Figure 3:
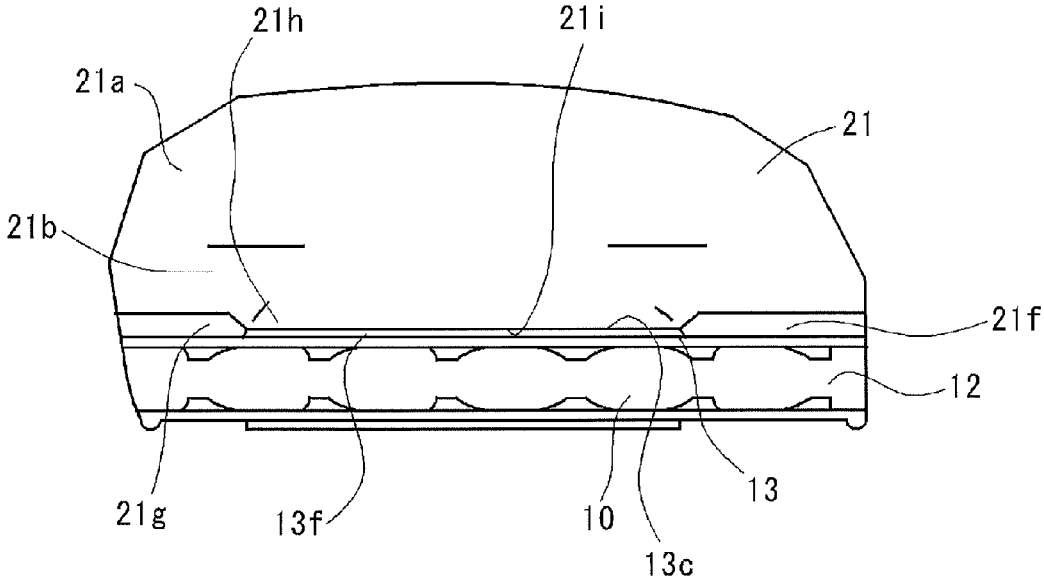
FIG. 3 is an enlarged view illustrating a main portion of the valve timing control apparatus according to the first embodiment.

The timing sprocket 10 includes a ring portion 11, which is formed into a substantially ring shape, and an attachment portion 13, which includes arc portions (protruding portions) 13*b*. Each of the arc portions 13*b* protrudes from an inner circumferential surface 11*a* of the ring portion 11 in a radially inner direction of the ring portion 11 to form a substantially arc shape (i.e., each of the arc portions 13*b* is formed into a protruding shape protruding toward an axis of the ring portion 11). A tooth portion 12 is formed at an outer circumferential surface of the ring portion 11. Screw holes 13*a* are formed in the attachment portion 13, respectively. As illustrated in FIG. 3, protrusions 13*f*, respectively having first end surfaces 13*c*, are formed at the attachment portion 13 so as to protrude toward a housing 21 (described later). The protrusions 13*f* are formed in a protruding manner so that the first end surfaces 13*c* are closer to the housing 21 than an end surface of the ring portion 11 facing the housing 21 and an end surface of the tooth portion 12 facing the housing 21. A timing chain for transmitting the driving force of the engine is engaged with the tooth portion 12. Fixing members 40 for fixing the timing sprocket 10 to the housing 21 are screwed through the corresponding screw holes 13*a*. Generally, a timing sprocket is made of a material, having a friction resistance and sufficient strength. Therefore, a cost and weight of the timing sprocket may be increased. However, according to the first embodiment, the timing sprocket 10 is formed into a substantially ring shape. Therefore, an amount of the material is reduced, and a cost and weight of the timing sprocket 10 are reduced. Further, a gear or a pulley may serve as the tooth portion 12.

Figure 4:
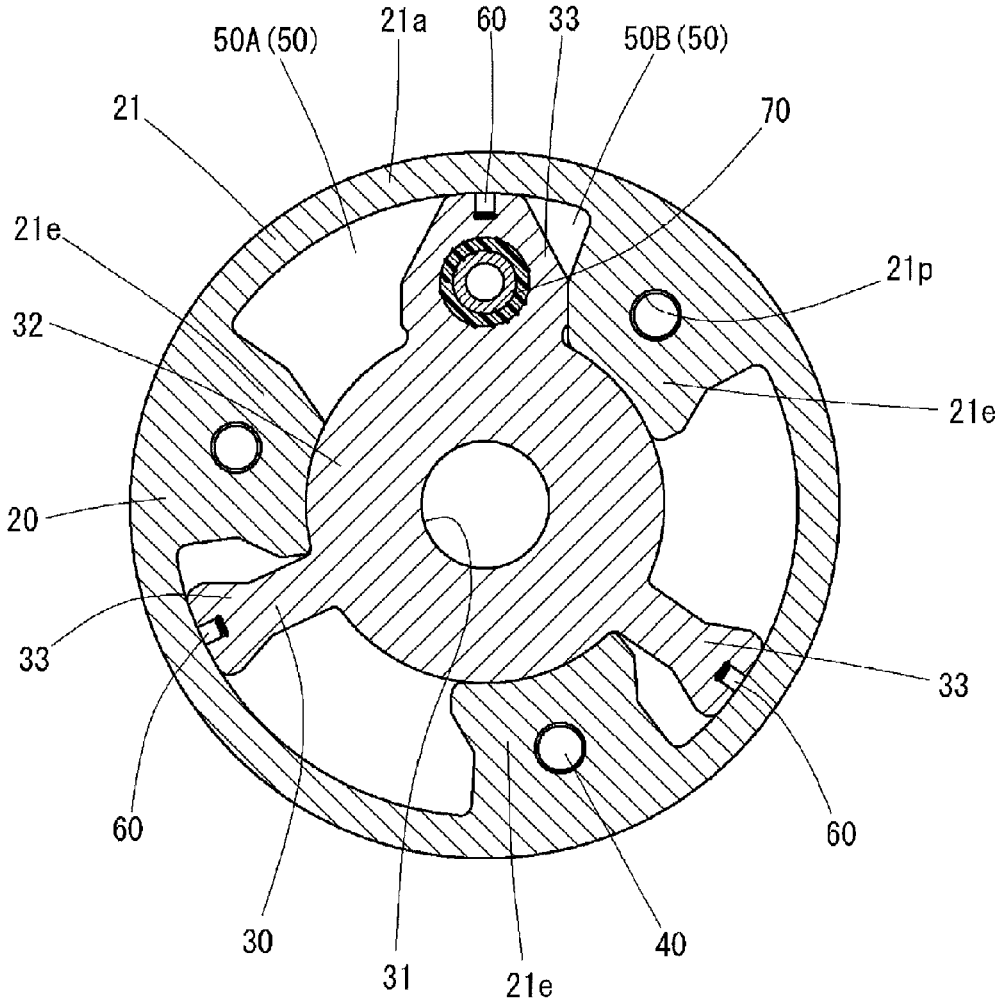
FIG. 4 is a diagram illustrating a housing and a rotor, which are assembled.
Figure 5:
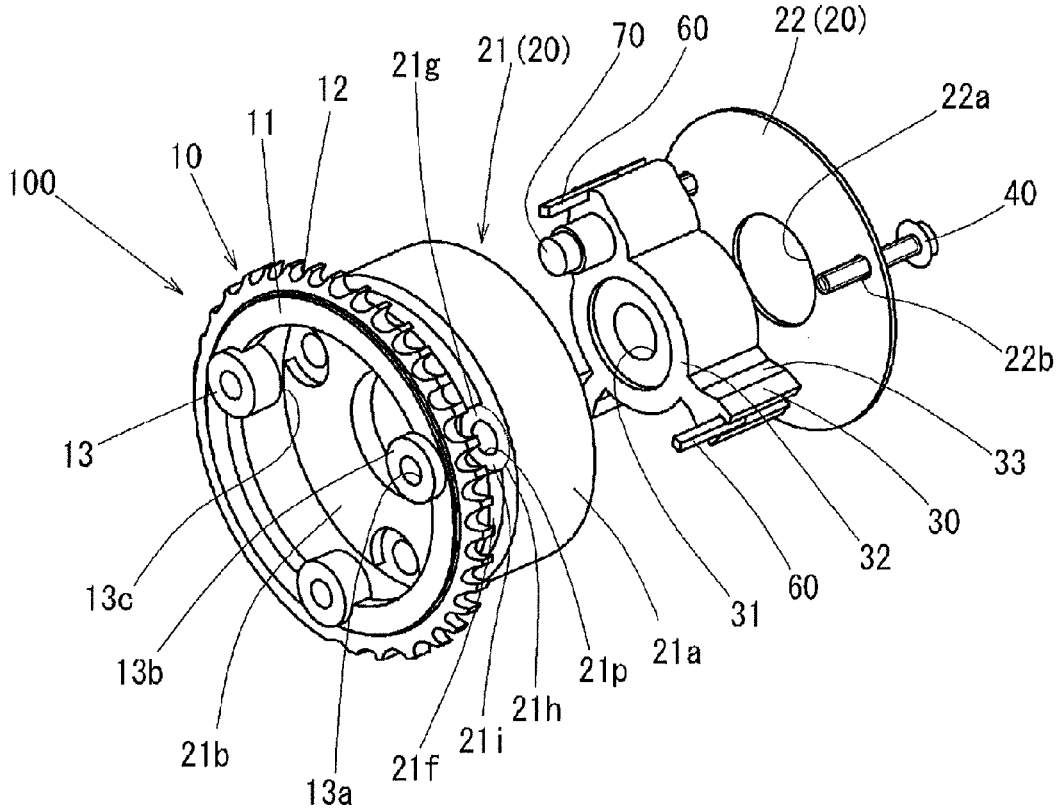
FIG. 5 is an exploded perspective view illustrating the valve timing control apparatus according to the first embodiment.

The driving side rotational member 20 is configured by the housing 21, formed into a substantially closed-end cylindrical shape, and by a plate member 22. The housing 21 includes a first cylindrical portion 21*a*, formed into a substantially cylindrical shape, and a bottom portion 21*b*, closing one end of the first cylindrical portion 21*a* in an axial direction of the housing 21. The first cylindrical portion 21*a* and the bottom portion 21*b* are integrally formed so as to form an accommodating portion 21*c*. The plate member 22 closes an opening portion 21*d* of the housing 21. As illustrated in FIG. 4, the first cylindrical portion 21*a* is formed with shoes 21*e*, which protrude in a radially inner direction of the first cylindrical portion 21*a*. First holes 21*p*, through which the fixing members 40 are inserted, are formed at the corresponding shoes 21*e*. A stepped portion 21*f* is formed at the bottom portion 21*b* of the housing 21, at which the timing sprocket 10 is fixed. The stepped portion 21*f* includes recessed portions 21*g*, each of which is recessed toward an axis of the housing 21 to form an arc shape (i.e., each of the recessed portions 21*g* is formed into a recessed shape recessed toward the axis of the housing 21). As illustrated in FIG. 3, a protruding portion 21*h*, which protrudes toward the timing sprocket 10, is formed on the recessed portions 21*g*. The plate member 22 is formed into a substantially disc shape. A second hole 22*a*, through which a bolt for fixing the rotor 30 to the camshaft 2 is inserted, is formed at the plate member 22. Third holes 22*b*, through which the fixing members 40 for fixing the plate member 22 to the housing 21, are formed at the plate member 22. Further, a through-hole 21*o*, through which the camshaft 2 is inserted so as to be connected to the rotor 30, is formed at the bottom portion 21*b* of the housing 21. A bearing portion between the housing 21 and the rotor 30 is configured by an inner circumferential surface of the through-hole 210 and an outer circumferential surface of the camshaft 2. According to such configuration of the bearing portion, the bearing portion and the timing sprocket 10 are arranged on the same imaginary straight line in a radial direction of the housing 21 (the rotor 30). The housing 21 does not directly receive the driving force. Therefore, the housing 21 may be made of aluminum by die-casting. Accordingly, a weight and cost of the housing 21 may be reduced. Further, because the housing 21 may be made of aluminum by die-casting, the housing 21 is formed to be solid. Therefore, oil leakage may be restricted and a performance of the valve timing control apparatus 100 may be improved.

The rotor 30 is assembled to the driving side rotational member 20 so as to be rotatable thereto. The rotor 30 includes a second cylindrical portion 32 and vanes 33. A fourth hole 31 for being engaged with the camshaft 2 is formed at the second cylindrical portion 32. Each of the vanes 33 protrudes from the second cylindrical portion 32 outwardly in the radial direction.

The rotor 30 is accommodated in the accommodating portion 21*c*, and then the plate member 22 is attached to the housing 21 so as to close the opening portion 21*d*, thereby the timing sprocket 10, the driving side rotational member 20 and the rotor 30 are assembled by the fixing members 40. According to the first embodiment, the timing sprocket 10 is fixed to the driving side rotational member 20 by means of the fixing members 40, screwed into the corresponding screw holes 13*a*. Alternatively, the timing sprocket 10 may be fixed to the driving side rotational member 20 by way of press-fitting, swaging, welding and the like.

When the timing sprocket 10 is fixed to the housing 21, the ring portion 11 is engaged with the stepped portion 21*f*, the arc portions 13*b* are engaged with the corresponding recessed portions 21*g*, formed into the arc shape, and the first end surfaces 13*c* contact second end surfaces 21*i*, respectively. Because the ring portion 11 is arranged at the stepped portion 21*f*, a length of the valve timing control apparatus 100 in an axial direction thereof may be shortened, and the timing sprocket 10 and the housing 21 may be coaxially arranged. Further, because the arc portions 13*b* are arranged at the corresponding recessed portions 21*g*, a displacement of the timing sprocket 10 relative to the housing 21 in a rotational direction may be restricted, and the first holes 21*q* and the corresponding screw holes 13*a* may be easily aligned. Therefore, the timing sprocket 10 and the housing 21 may be easily fixed to each other by the fixing means 40. Furthermore, the first end surfaces 13*c* contact second end surfaces 21*i*, respectively. Therefore, the timing sprocket 10 and the housing 21 may be accurately assembled. A portion to be processed for a sufficient accuracy of assembly may be only the first end surfaces 13*c* in the timing sprocket 10. Therefore, a cost may be decreased.

The rotor 30 is accommodated in the accommodating portion 21*c* of the housing 21 (the driving side rotational member 20) so that the vanes 33 of the rotor 30 are respectively arranged between the adjacent shoes 21*e*. Consequently, hydraulic pressure chambers 50 are respectively formed between the adjacent shoes 21*e*. Each of the hydraulic pressure chambers 50 is divided into a first pressure chamber 50A and a second pressure chamber 50B by means of the vane 33. The rotor 30 is rotatably assembled to the housing 21 so that inner end portions of the shoes 21*e* in the radial direction contact an outer circumferential surface of the second cylindrical portion 32. Seal members 60 are respectively provided to outer end portions of the vanes 33 in the radial direction so as to be biased outwardly in the radial direction. An outer end surface of each of the seal members 60 in the radial direction contact an inner circumferential surface of the first cylindrical portion 21*a* of the housing 21 so as to liquid-tightly divide the hydraulic pressure chamber 50 into the first pressure chamber 50A and the second pressure chamber 50B.

According to the above-described configurations, when hydraulic oil is supplied to or discharged from the first and second pressure chambers 50A and 50B through a hydraulic passage by means of a hydraulic pressure device, a rotational phase of the driving side rotational member 20 relative to the rotor 30 is changed in an advanced angle direction or in a retarded angle direction.

A lock member 70 is attached to one of three vanes 33 so as to be movable in the axial direction. The lock member 70 is provided so as to be engageable with and disengageable from a fifth hole 21*j*, formed at the bottom portion 21*b* at a side thereof facing the accommodating portion 21*c*. When the engine is started, the lock member 70 engages with the fifth hole 21*j* so as to fix the rotational phase of the driving side rotational member 20 relative to the rotor 30.

[Second Embodiment]

A second embodiment of a valve timing control apparatus 200 will be described hereinafter with reference FIG. 6.

Figure 6:
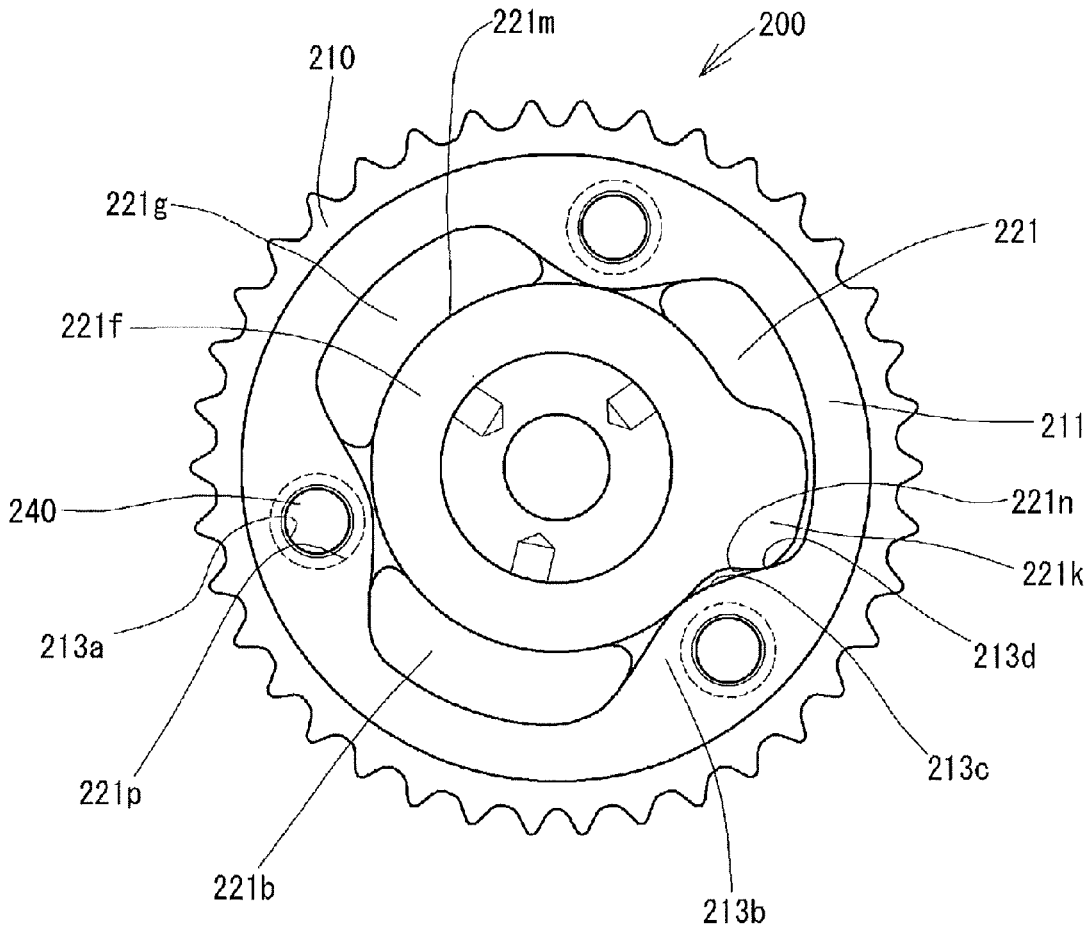
FIG. 6 is a back surface view illustrating the valve timing control apparatus according to a second embodiment.

FIG. 6 is a back view illustrating the valve timing control apparatus 200 according to the second embodiment.

According to the valve timing control apparatus 200 of the second embodiment, shapes of a bottom portion 221*b* of a housing 221 and arc portions 213*b* of a timing sprocket (a driving force transmission member) 210 are different from the first embodiment. However, other configurations and functions are similar to the first embodiment. Therefore, description for the similar configuration and functions will be omitted.

A first protruding portion 221*f* and a second protruding portion 221*k* are formed at the bottom portion 221*b* of the housing 221 at a side where the timing sprocket 210 is fixed. The first protruding portion 221*f* is formed into a substantially ring shape, protruding in the axial direction. A hole, with and from which a lock member is engaged and disengaged, is formed at the first protruding portion 221*f*. Further, a circumferential-direction side surface portion (recessed portion) 221*n*, which is formed to protrude in the axial direction and to recess toward the axis, is formed at the second protruding portion 221*k*. The housing 221 is arranged at the timing sprocket 210 so that an outer circumferential surface 221*m* of the first protruding portion 221*f* contacts radial-direction inner side surfaces 213*c* of the arc portions 213*b* of the timing sprocket 210. Further, the housing 221 is arranged at the timing sprocket 210 so that the circumferential-direction side surface portion 221*n* of the second protruding portion 221*k* contacts a circumferential-direction inner side surface 213*d* of the arc portion 213*b* of the timing sprocket 210. A stepped portion 221*g* is formed at a ring portion 211 so as to be stepped relative to the first protruding portion 221*f*, which is formed in a protruding manner in the vicinity of a portion where the housing 221 is engaged with the camshaft. The ring portion 211 and the arc portions 213*b* of the timing sprocket 210 are fixed to the stepped portion 221*g* of the housing 221. Therefore, a length of the valve timing control apparatus 200 in the axial direction may be shortened. The outer circumferential surface 221*m* of the housing 221 contacts the radial-direction inner side surfaces 213*c* of the arc portions 213*b* of the timing sprocket 210. Therefore, the timing sprocket 210 and the housing 221 may be coaxially arranged. The circumferential-direction inner side surface 213*d* of the arc portion 213*b* of the timing sprocket 210 contacts the circumferential-direction side surface portion 221*n*. Therefore, a displacement of the timing sprocket 210 relative to the housing 221 in a rotational direction may be restricted. Therefore, first holes 221*p* and corresponding screw holes 213*a* may be easily aligned. Accordingly, the timing sprocket 210 and the housing 221 may be easily fixed to each other by means of fixing means 240.

The timing sprocket 10 and 210 is formed into a substantially ring shape. Accordingly, an amount of a material may be reduced, and a cost and weight of the valve timing control apparatus 100 and 200 may be reduced.

According to the embodiment, the protrusion 13*f* is formed at the timing sprocket 10 and 210. The timing sprocket 10 and 210 is attached to the driving side rotational member 20 in a manner where the protrusion 13*f* contacts the bottom portion 21*b* of the housing 21 and 221.

Accordingly, a portion to be processed for a sufficient accuracy of assembly may be only a protrusion 13*f* in the timing sprocket 10 and 210. Therefore a cost of the valve timing control apparatus 100 and 200 may be reduced.

According to the embodiment, the timing sprocket 10 and 210 is attached to the housing 21 and 221 at a stepped portion 21*f* formed into a ring shape at the bottom portion 21*b* of the housing 21 and 221.

Accordingly, a length of the valve timing control apparatus 100 and 200 in the axial direction is shortened, thereby reducing size and weight thereof.

According to the embodiment, the timing sprocket 10 and 210 is attached to the housing 21 and 221 in a manner where the arc portion 13*b*, formed at the timing sprocket 10 and 210 so as to protrude toward an axis of the timing sprocket 10 and 210, is engaged with the recessed portion 21*g*, formed at the stepped portion 21*f* of the housing 21 and 221 so as to recess toward an axis of the housing 21 and 221.

Accordingly, the arc portion 13*b* is engaged with the recessed portion 21*g*. Therefore, the timing sprocket 10 and 210 may be easily coaxially provided to the driving side rotational member 20. Therefore, the valve timing control apparatus 100 and 200 may be easily assembled.

According to the embodiment, the through-hole 21*o*, through which the camshaft 2 is inserted to be connected to the rotor 30, is formed at the bottom portion 21*b* of the housing 21 and 210 to extend therethrough in an axial direction of the camshaft 2. The bearing portion between the driving side rotational member 20 and the rotor 30 is configured by an inner circumferential surface of the through-hole 210 and at least one of an outer circumferential surface of the camshaft 2 and an outer circumferential surface of the rotor 30.

In a configuration where the timing sprocket 10 and 210 is attached to the bottom portion 21*b* of the housing 21 for configuring the driving side rotational member 20, a load from the timing sprocket 10 and 210 is applied to the housing 21 and 221. The load may cause a displacement of the coaxial alignment of the driving side rotational member 20 and the rotor 30. Consequently, a sliding resistance between the driving side rotational member 20 and the rotor 30 may be increased, thereby causing difficulties in smoothly changing the rotational phase of the rotor 30 relative to the driving side rotational member 20. However, the bearing portion between the driving side rotational member 20 and the rotor 30 is configured by the inner circumferential surface of the through-hole 210 and at least one of the outer circumferential surface of the camshaft 2 and the outer circumferential surface of the rotor 30. Therefore, the bearing portion and the timing sprocket 10 and 210 are aligned on the same imaginary line in a radial direction of the driving side rotational member (rotor 30). Accordingly, the above-mentioned drawback such that the load may cause a displacement of the coaxial alignment of the driving side rotational member 20 and the rotor 30, and that a sliding resistance between the driving side rotational member 20 and the rotor 30 may be increased, thereby causing difficulties in smoothly changing the rotational phase of the rotor 30 relative to the driving side rotational member 20, may be less likely to occur.

According to the embodiment, the arc portion 13*b* of the timing sprocket 10 and 210 is set to be longer than the other portions of the timing sprocket 10 and 210 in an axial direction of the camshaft 2.

According to the embodiment, the driving side rotational member 20 is made of aluminum. The timing sprocket 10 and 210 is made of a material having larger strength than the driving side rotational member 20.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving force transmission member;

a protrusion formed at the driving force transmission member;

a driving side rotational member, to which a driving force of an internal combustion engine is transmitted from a crank shaft of the internal combustion engine by the driving force transmission member;

a driven side rotational member coaxially provided to the driving side rotational member, and rotating relative to the driving side rotational member, thereby rotating a camshaft for opening and closing a valve;

a hydraulic pressure chamber formed by the driving side rotational member and the driven side rotational member, and changing a rotational phase of the driven side rotational member relative to the driving side rotational member to an advanced angle direction or a retarded angle direction according to a supply of a hydraulic oil to the hydraulic pressure chamber;

wherein the driving side rotational member includes a housing formed into a closed-end cylindrical shape and having a bottom portion formed to close one end of the housing in an axial direction thereof and an opening portion formed to be opened at the other end the housing in the axial direction thereof, and a plate member closing the opening portion of the housing, wherein the driving force transmission member, formed into a ring shape, is attached to the bottom portion of the housing; and wherein the driving force transmission member is attached to the driving side rotational member in a manner where the protrusion contacts the bottom portion of the housing.

2. The valve timing control apparatus according to claim 1, wherein the driving force transmission member is attached to the housing at a stepped portion formed into a ring shape at the bottom portion of the housing.

3. The valve timing control apparatus according to claim 2, wherein the driving force transmission member is attached to the housing in a manner where a protruding portion, formed at the driving force transmission member so as to protrude toward an axis of the driving force transmission member, is engaged with a recessed portion, formed at the stepped portion of the housing so as to recess toward an axis of the housing.

4. The valve timing control apparatus according to claim 3, wherein a through-hole, through which the camshaft is inserted to be connected to the driven side rotational member, is formed at the bottom portion of the housing to extend therethrough in an axial direction of the camshaft, and wherein a bearing portion between the driving side rotational member and the driven side rotational member is configured by an inner circumferential surface of the through-hole and at least one of an outer circumferential surface of the camshaft and an outer circumferential surface of the driven side rotational member.

5. The valve timing control apparatus according to claim 2, wherein a through-hole, through which the camshaft is inserted to be connected to the driven side rotational member, is formed at the bottom portion of the housing to extend therethrough in an axial direction of the camshaft, and wherein a bearing portion between the driving side rotational member and the driven side rotational member is configured by an inner circumferential surface of the through-hole and at least one of an outer circumferential surface of the camshaft and an outer circumferential surface of the driven side rotational member.

6. The valve timing control apparatus according to claim 1, wherein the driving force transmission member is attached to the housing in a manner where a protruding portion, formed at the driving force transmission member so as to protrude toward an axis of the driving force transmission member, is engaged with a recessed portion, formed at the stepped portion of the housing so as to recess toward an axis of the housing.

7. The valve timing control apparatus according to claim 6, wherein a through-hole, through which the camshaft is inserted to be connected to the driven side rotational member, is formed at the bottom portion of the housing to extend therethrough in an axial direction of the camshaft, and wherein a bearing portion between the driving side rotational member and the driven side rotational member is configured by an inner circumferential surface of the through-hole and at least one of an outer circumferential surface of the camshaft and an outer circumferential surface of the driven side rotational member.

8. The valve timing control apparatus according to claim 7, wherein the protruding portion of the driving force transmission member is set to be longer than the other portions of the driving force transmission member in an axial direction of the camshaft.

9. The valve timing control apparatus according to claim 6, wherein the protruding portion of the driving force transmission member is set to be longer than the other portions of the driving force transmission member in an axial direction of the camshaft.

10. The valve timing control apparatus according to claim 1, wherein a through-hole, through which the camshaft is inserted to be connected to the driven side rotational member, is formed at the bottom portion of the housing to extend therethrough in an axial direction of the camshaft, and wherein a bearing portion between the driving side rotational member and the driven side rotational member is configured by an inner circumferential surface of the through-hole and at least one of an outer circumferential surface of the camshaft and an outer circumferential surface of the driven side rotational member.

11. The valve timing control apparatus according to claim 1, wherein a through-hole, through which the camshaft is inserted to be connected to the driven side rotational member, is formed at the bottom portion of the housing to extend therethrough in an axial direction of the camshaft, and wherein a bearing portion between the driving side rotational member and the driven side rotational member is configured by an inner circumferential surface of the through-hole and at least one of an outer circumferential surface of the camshaft and an outer circumferential surface of the driven side rotational member.

12. The valve timing control apparatus according to claim 1, wherein the driving side rotational member is made of aluminum, and wherein the driving force transmission member is made of a material having larger strength than the driving side rotational member.

* * * * *